United States Patent [19]

Pfaffle

[11] 4,252,483

[45] Feb. 24, 1981

[54] AUTOMATIC BOOK STRIP FEEDER

[75] Inventor: Ernst Pfaffle, Neuffen, Fed. Rep. of Germany

[73] Assignee: Hans Sickinger Company, Pontiac, Mich.

[21] Appl. No.: 892,280

[22] Filed: Mar. 31, 1978

[51] Int. Cl.[3] ..... B65G 59/06

[52] U.S. Cl. ..... 414/115; 198/443; 221/277; 271/315; 414/129

[58] Field of Search ..... 414/32, 33, 112, 113, 414/114, 115, 125, 126, 127, 128, 129, 130; 221/42, 43, 40, 110, 217, 218, 222, 277, 297; 271/16, 21, 23, 314, 315

[56] References Cited

U.S. PATENT DOCUMENTS

| | | | |
|---|---|---|---|
| 3,146,897 | 9/1964 | Curtenius et al. | 414/114 |
| 3,452,628 | 7/1969 | Pfaffle . | |
| 3,627,152 | 12/1971 | Pfaffle | 414/115 |
| 3,690,475 | 9/1972 | Pfaffle | 414/115 |
| 3,973,767 | 8/1976 | Kramer | 414/129 X |

FOREIGN PATENT DOCUMENTS

| | | | |
|---|---|---|---|
| 337553 | 5/1959 | Switzerland | 414/128 |
| 971906 | 10/1964 | United Kingdom | 414/114 |

*Primary Examiner*—Frank E. Werner

*Attorney, Agent, or Firm*—Harness, Dickey & Pierce

[57] ABSTRACT

A high speed machine which successively removes unbound book pad strips from the bottom of a stack and feeds them toward a glueing machine. The feeder is adapted for different strip sizes including larger sizes and comprises stack guide device disposed above synchronized, rotating, slotted discs which support the forward edge of the stack bottom. The strips in the stack are provided with cardboard separators therebetween and a knife enters the stack bottom and lifts all except the lowermost strip to permit the leading edge of the first slotted disc to enter. The rotating discs progressively push the leading edge of the lowermost strip downwardly past a group of rollers. These rollers, which are movably mounted, are then depressed to press the lowermost strip against an endless belt. The belt carries the stack to a rotating carriage which will deposit the stack in the glueing machine.

2 Claims, 6 Drawing Figures

AUTOMATIC BOOK STRIP FEEDER

BACKGROUND OF THE INVENTION

1. Field of the Invention

The invention relates to the feeding of collated sheet pad strips (a strip being an uncut and unglued group of pads) to a machine such as a rotating table at which the strips are edge-milled and glued. In particular, the invention pertains to the rapid feeding of such collated units so that the capacity of the glueing or other machine will be fully utilized.

2. Description of the Prior Art

At present, the glueing machine, called a circular padder, is fed by an operator who is stationed at one of the positions of the rotary table. The operator takes one group of sheets at a time and places the group in vertical position between clamps on the table. The table rotates to a milling station, where the under edges of the sheets are milled, and then to a glueing station. The operator is only capable of feeding the sheet groups in this manner at a limited rate, whereas the circular padder has the capacity of glueing the strips at a much higher rate.

U.S. Pat. No. 3,452,628, issued July 1, 1969 and entitled Hole Punching Machine for Paper Sheets shows a slotted disc construction which bears some similarity to those disclosed in the present invention, but the construction shown in that patent would be incapable of carrying out the objects of the present invention.

BRIEF SUMMARY OF THE INVENTION

It is the object of the present invention to increase the production capability of machines such as the above described circular padder by feeding sheet groups in a rapid manner from a stack of such groups into a position where they can be dropped vertically and thus loaded into the padder.

It is a further object to provide an improved feeding device of this nature which can be adjusted for various sheet sizes, and is economical to construct and reliable in operation.

Briefly, the book strip feeder comprises guide means for retaining a stack of sheet groups so that each group of the stack has a forward portion facing in one direction and a rearward portion facing in the opposite direction, a conveyor having a pickup portion spaced below said forward stack portion and extending therefrom in one direction toward a discharge end, means supporting a portion of said stack rearwardly of said forward portion, movable stack supporting means supporting the forward portion of said stack, and sheet group lowering means adjacent said movable stack supporting means and movable between upper and lower positions, the movable stack supporting means including means responsive to movement thereof for entering between the lowermost sheet group and the remainder of said stack and thereafter depressing said lowermost sheet group below said sheet group lowering means while the latter are in their upper position, whereby subsequent movement of said sheet group lowering means to their lower position will cause said lowermost sheet group to engage said conveyor pickup portion and be withdrawn from said stack for transport to said discharge end.

DESCRIPTION OF THE PREFERRED EMBODIMENTS

Figure 1:
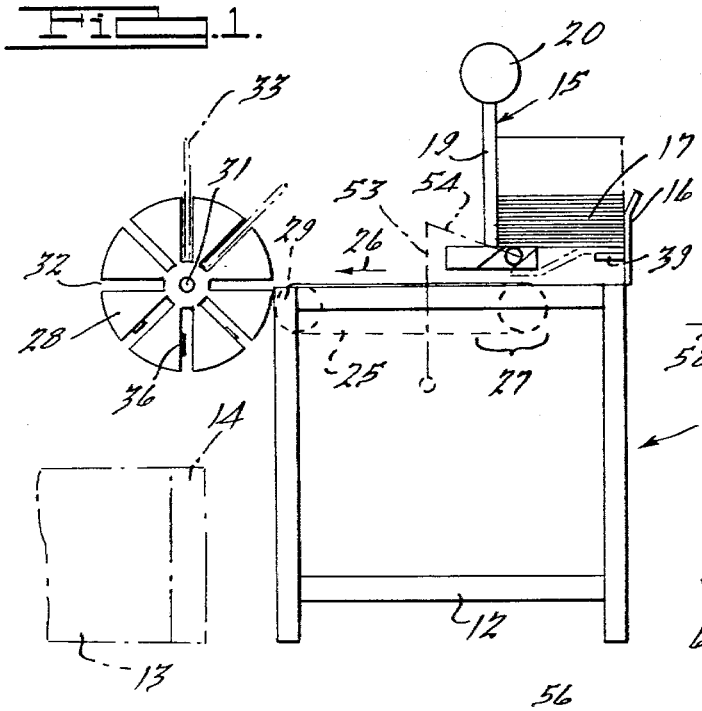
FIG. 1 is a side elevational view which is partially schematic and shows the construction of this invention.

The book strip feeder of this invention is generally indicated at 11 and is mounted on a rectangular base 12. The base is positioned adjacent a machine indicated schematically at 13 which could be a circular padder as described above. This conventional unit comprises an indexable rotary table having slots or pockets 14 into each of which may be dropped, at a loading station, a sheet group which is to be glued. This sheet group may, for example, be a strip of pads, that is, an elongated sheet group which will later be cut cross-wise into several pads. The table 13 indexes to edge milling and then to glueing stations, and the purpose of machine 11 is to drop each sheet group into a pocket 14 at the loading station. Machine 11 is thus located at the loading station for pockets 14.

The machine comprises stack retaining means indicated generally at 15 which may include a guide 16 for the rearward edge of a stack 17 of sheet groups, a side member 18, and a member 19 which may serve also to support driving means 20 for discs to be described later. Another portion of the stack retaining means is indicated at 21 in FIG. 2. The stack retaining means has adjusting means indicated schematically by the double ended arrows 22 and 23 for different sizes of sheet groups. These sizes are indicated by the various dot-dash lines 24 in FIG. 2.

An endless conveyor shown as a belt conveyor 25 is mounted on the upper portion of base 12. The top of the conveyor is adapted to move in the direction of the arrow 26 in FIG. 1 as driven by drive means 20. The rearward portion of conveyor 25 is disposed beneath the forward portion 27 of stack 17. A rotary carriage 28 is mounted on a horizontal axis adjacent the delivery end 29 of conveyor 25 and above the position of pockets 14 when they reach the loading station. Means indicated partially at 31 are provided for indexing carriage 28. The carriage is provided with slots 32 for receiving a sheet group 33 fed thereto by conveyor 25. The indexing means is such that each time the carriage is rotated a slot 32 will be aligned with the discharge end 29 of conveyor 25. The carriage will then carry the sheet group received by slot 32 to a vertical position. To accomplish this, the carriage may rotate either clockwise or counter-clockwise in FIG. 1. If rotating counter-clockwise, sheet group 33 is above the axis of the carriage and may be discharged in either direction by means indicated schematically by the arrow 34 in FIG. 2. A chute indicated schematically at 35 in FIG. 2 may be provided for guiding discharge sheet group 33 to pocket 14. If the carriage rotates clockwise in FIG. 1, pocket 14 may be positioned directly below the carriage. In this case, clamping means indicated partially at 36 will be provided for each pocket of the carriage so that when the group sheet reaches its vertical position the clamp may release it and it will then drop into the pocket.

Figure 2:
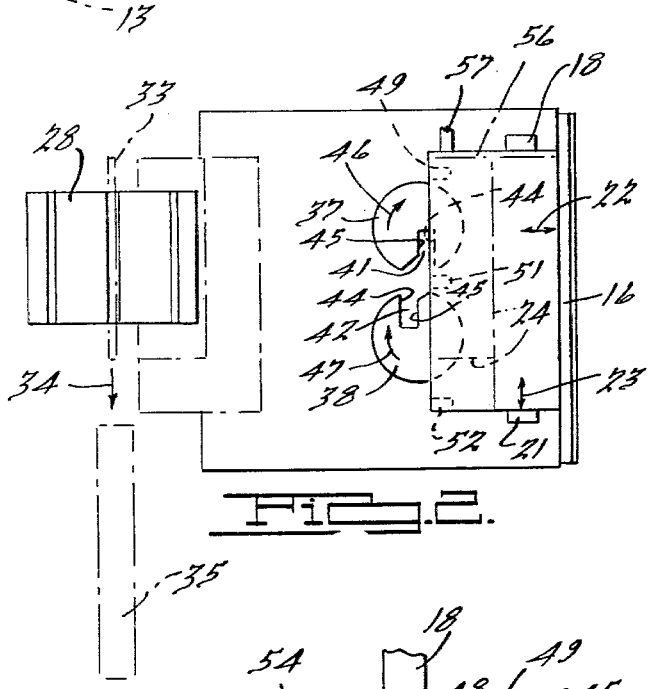
FIG. 2 is a top plan view thereof, parts being omitted for clarity.

The means for supporting forward portion 27 of stack 17 comprises a pair of discs 37 and 38 alongside each other as shown in FIG. 2. These discs are rotatable on vertical axes so located that approximately one-half of each disc supports the stack. The rearward portion of the stack is supported by a stationary platform 39, the intermediate portion of the stack being unsupported. Discs 37 and 38 are provided with slots 41 and 42 respectively which extend close to the mid-point of the discs. The construction of the discs is in some aspects similar to that shown in my U.S. Pat. No. 3,452,628 entitled Hole Punching Machine for Paper Sheets, issued July 1, 1969.

Figure 3:
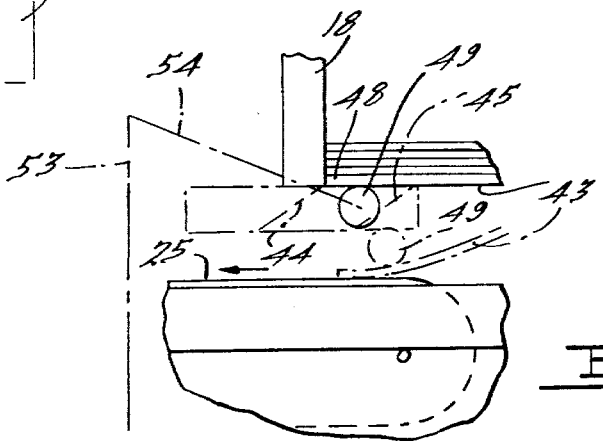
FIG. 3 is an enlarged fragmentary elevational view of a portion of FIG. 1 showing the relationship of the stack supporting discs, rollers and endless conveyor.

The discs have an effective thickness as shown schematically in FIG. 3 so as to depress the forward portion of lowermost sheet group 43 the required distance as described below. Each slot 41 and 42 has a leading edge 44 and a trailing edge 45. These edges are shown 180° out of position in FIGS. 1 and 3 for purposes of explanation. Actually the discs are rotated as shown by the arrows 46 and 47 in FIG. 2 so that the leading edge 44 of disc 47 will enter the gap (described below) between sheet group 43 and the stack adjacent one side of the stack. As disc 37 rotates it will progressively depress the forward portion 48 of sheet group 43 until, when the slot 41 has reached the position shown in FIG. 2, the entire portion of sheet group 43 which had previously been supported by disc 37 will be depressed below said disc. The discs are so synchronized that at this point the leading edge 44 of disc 38 will enter the gap between sheet group 43 and the stack. Disc 38 will act like disc 37 to progressively depress sheet group 43 along its forward portion 48 until, when disc 38 is rotated 180° the entire forward portion 48 of sheet group 43 will be depressed below both discs. At this point the discs will support the rest of the stack in readiness for depressing the next sheet group.

A plurality of rollers 49, 51 and 52 are provided below forward portion 27 of stack 17. The purpose of these rollers is to urge the forward portion 48 of a sheet group 43 which has passed below discs 37 and 38 against the receiving portion of endless conveyor 25, so that the conveyor will pull this sheet group from stationary support 39 and carry the sheet group to carriage 28. For this purpose rollers 49, 51 and 52 are located alongside the discs, roller 51 being between the discs and rollers 49 and 52 on the outsides of discs 37 and 38 respectively. Movable supporting means indicated schematically at 53 and 54 are provided for rollers 49, 51 and 52. This means is such as to move the rollers in unison between an upper or solid line position as shown in FIG. 3 and a lower or dot-dash line position. When in their upper position the rollers are immediately below forward portion 48 of sheet group 43, and the diameter of the rollers relative to the thickness of the discs is such that after the discs have been rotated as described above forward edge 48 of sheet group 43 will be depressed below the rollers which are still in their upper position. Means 53 and 54 are synchronized with the movement of the discs so that after sheet group 43 has been depressed by both discs the rollers will be moved to their lower position, pressing the forward portion 48 of the sheet group against conveyor 25. After the sheet group has been withdrawn from support 39 and is moving toward carriage 28 the rollers will be returned to their upper position.

Figure 4:
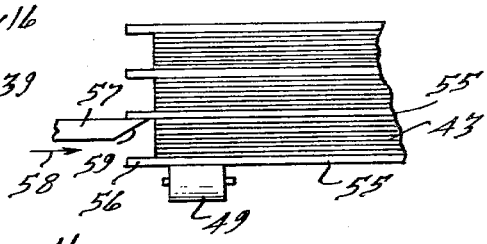
FIG. 4 is a fragmentary elevational view showing the co-action between the knife and the sheet group separating sheets.
Figure 5:
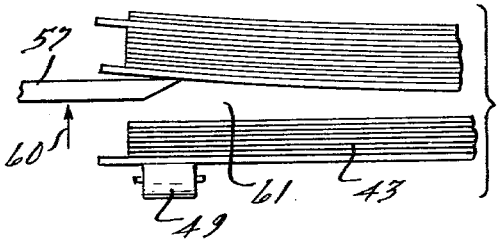
FIG. 5 is a view similar to FIG. 3 showing how the knife lifts the stack to create a gap.
Figure 6:
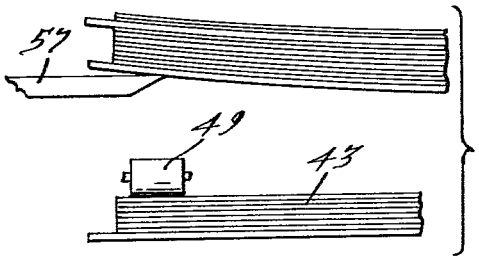
FIG. 6 is a view similar to FIGS. 3 and 4 showing the position of the lowermost sheet group after the first disc has been rotated to depress the sheet group below the adjacent roller.

Means are provided for insuring that the leading edge 44 of disc 37 will enter the stack at the proper place for the removal of each sheet group, it being kept in mind that the machine is to be used for collated sheet groups so that accuracy in the removal of each sheet group is important. The means comprises separating sheets such as cardboard 55 between adjacent sheet groups. Projecting portions 56 of sheets 55 along the side of the stack adjacent disc 37 permit a knife 57 to enter immediately below the separating sheet 55 above the lowermost sheet group 43, as shown in FIG. 4. Means indicated schematically by the arrows 58 and 60 are provided for first moving knife 57 inwardly toward the stack so that the inclined edge 59 of the knife may enter immediately above sheet group 43 as shown in FIG. 5. Knife 57 will then be lifted to create a gap 61 which may be entered by leading edge 44 of disc 37. As the disc rotates it will depress sheet group 43 below the adjacent roller 49 as shown in FIG. 6.

The operation of machine 11 will be apparent from the foregoing description. Each full rotation of discs 37 and 38 will result in the forward portion of a sheet group being depressed below rollers 49, 51 and 52 and being pressed by the rollers against endless conveyor 25 so that the sheet group will be carried to carriage 28. The carriage will move the sheet group to a vertical position from where it can be discharged into the pocket 14 of machine 13.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A book strip feeder comprising guide means for retaining a stack of sheet groups so that each group of the stack has a forward portion facing in one direction and a rearward portion facing in the opposite direction, an endless conveyor having a pickup portion spaced below said forward stack portion and extending therefrom in one direction toward a discharge end, an indexing rotary carriage adjacent said discharge end of the conveyor and having pockets for receiving sheet groups delivered successively thereto, stationary means supporting the rearward portion of said stack, a pair of slotted discs supporting said forward stack portion, each disc having a slot with a leading edge capable of entering a gap between sheet groups when the disc is rotated, and a trailing edge, said edges being so shaped that the portion of the sheet group supported by a disc will pass below the disc as the slot passes thereacross, means rotating said discs in synchronism whereby the forward portion of the bottom sheet group will be progressively depressed from one side to the other as the discs rotate, a plurality of rollers below said forward stack portion and positioned alongside said discs, means movably supporting said rollers for movement between upper and lower positions, the thickness of the discs being such that the discs will depress the forward portion of the lowermost sheet group below said rollers when the rollers are in their upper position, means for thereafter moving said rollers toward their lower position whereby the depressed forward portion of said lowermost sheet group will be pressed against said endless conveyor, thereby causing the conveyor to withdraw the rearward portion of said sheet group from said stationary support and cause the sheet group to be fed to said carriage, said stack retaining means being adjustable to retain different sizes of sheet groups, and drive means for said discs, said stack guide means comprising at least one member which also supports said disc drive means.

2. A book strip feeder comprising guide means for retaining a stack of sheet groups so that each group of the stack has a forward portion facing in one direction and a rearward portion facing in the opposite direction, an endless conveyor having a pickup portion spaced below said forward stack portion and extending therefrom in one direction toward a discharge end, an indexing rotary carriage adjacent said discharge end of the conveyor and having pockets for receiving sheet groups delivered successively thereto, stationary means supporting the rearward portion of said stack, a pair of slotted discs supporting said forward stack portion, each disc having a slot with a leading edge capable of entering a gap between sheet groups when the disc is rotated, and a trailing edge, said edges being so shaped that the portion of the sheet group supported by a disc will pass below the disc as the slot passes thereacross, means rotating said discs in synchronism whereby the forward portion of the bottom sheet group will be progressively depressed from one side to the other as the discs rotate, a plurality of rollers below said forward stack portion and positioned alongside said discs, means movably supporting said rollers for movement between upper and lower positions, the thickness of the discs being such that the discs will depress the forward portion of the lowermost sheet group below said rollers when the rollers are in their upper position, means for thereafter moving said rollers toward their lower position whereby the depressed forward portion of said lowermost sheet group will be pressed against said endless conveyor, thereby causing the conveyor to withdraw the rearward portion of said sheet group from said stationary support and cause the sheet group to be fed to said carriage, means for removing a sheet group laterally from said carriage, and a chute for receiving and guiding the removed sheet group.

* * * * *